US010016874B2

(12) United States Patent
Koechl

(10) Patent No.: US 10,016,874 B2
(45) Date of Patent: Jul. 10, 2018

(54) PROCESS FOR THE PRODUCTION OF A CUP WHEEL

(71) Applicant: Tyrolit—Schleifmittelwerke Swarovski K.G., Schwaz (AT)

(72) Inventor: Harald Koechl, Schwaz (AT)

(73) Assignee: TYROLIT—SCHLEIFMITTELWERKE SWAROVSKI K.G., Schwaz (AT)

( * ) Notice: Subject to any disclaimer, the term of this patent is extended or adjusted under 35 U.S.C. 154(b) by 360 days.

(21) Appl. No.: 14/632,190

(22) Filed: Feb. 26, 2015

(65) Prior Publication Data

US 2015/0246428 A1 Sep. 3, 2015

(30) Foreign Application Priority Data

Feb. 28, 2014 (AT) ..... 142/2014

(51) Int. Cl.

| | |
|---|---|
| ***B24D 5/06*** | (2006.01) |
| ***B24D 7/16*** | (2006.01) |
| ***B24D 18/00*** | (2006.01) |
| ***B24D 7/02*** | (2006.01) |

(52) U.S. Cl.
CPC ..... *B24D 7/16* (2013.01); *B24D 7/02* (2013.01); *B24D 18/0009* (2013.01)

(58) Field of Classification Search
CPC ... B24D 5/06; B24D 7/16; B24D 7/02; B24D 18/0009
USPC ..... 51/295
See application file for complete search history.

(56) References Cited

U.S. PATENT DOCUMENTS

| | | | | |
|---|---|---|---|---|
| 2,469,398 A | | 4/1946 | Meyer | |
| 2,703,437 A | | 3/1955 | Lindblad | |
| 2,942,387 A | * | 6/1960 | Lindblad | B24D 7/10 451/548 |
| 4,246,004 A | * | 1/1981 | Busch | B24D 99/005 451/542 |
| 6,093,092 A | * | 7/2000 | Ramanath | B24D 5/06 451/527 |

FOREIGN PATENT DOCUMENTS

| | | |
|---|---|---|
| DE | 26 14 743 | 10/1976 |
| DE | 25 48 281 | 5/1977 |
| EP | 2 119 524 | 11/2009 |
| GB | 451641 | 8/1936 |
| GB | 557194 | 11/1943 |

OTHER PUBLICATIONS

English Translation of Austrian Search Report dated Dec. 16, 2014 in Austrian Patent Application No. A 142/2014.

* cited by examiner

*Primary Examiner* — Pegah Parvini
(74) *Attorney, Agent, or Firm* — Wenderoth, Lind & Ponack, L.L.P.

(57) ABSTRACT

A cup grinding wheel includes a cup-shaped carrier, and an annular grinding body. The annular grinding body is connected to the cup-shaped carrier by a single hot-pressing operation, and the annular grinding body is connected only by a binding region having an annular surface to an annular mounting surface of the cup-shaped carrier.

21 Claims, 2 Drawing Sheets

PROCESS FOR THE PRODUCTION OF A CUP WHEEL

BACKGROUND OF THE INVENTION

1. Field of the Invention

The invention concerns a cup grinding wheel including:

a cup-shaped carrier, and an annular grinding body, wherein the grinding body is connected to the carrier by a single hot-pressing operation.

The invention further seeks to provide a process for the production of the cup wheel according to the invention.

2. Description of the Related Art

Such cup wheels are already part of the state of the art and are shown, for example, in DE 25 48 28 1 C2 and DE 26 14 743 A1.

Cup grinding wheels are used for grinding metals like, for example, in tool grinding. These include, for example, machining processes like slot grinding, bevel grinding, finishing machining of boring tools and drills and tools, and so forth. A cup grinding wheel substantially comprises a carrier (grinding cup) and a grinding body of annular shape which at its surface has or provides grinding faces. The grinding faces are provided with super abrasive means like, for example, CBN or diamond which are bound together in a metal and/or synthetic resin binding.

There are several possible ways of producing a standard cup wheel, in which firstly the grinding body is produced, by the binding agent and the super abrasive means being introduced into a mold and then hot-pressed. After that hot-pressing operation, the annular grinding body is removed from the mold and put into a further mold. That further second mold is such that it predetermines the geometry of the carrier (grinding cup). The binding powder (binding agent) for the carrier, in the form of metal powder, synthetic resin, metal-synthetic resin mixture, etc., is introduced into that second mold and then hot-pressed. Two hot-pressing operations are required. The cup grinding wheel is finished after being removed from the mold. In the inside, the grinding cup has a supporting geometry in the region of the grinding body. That supporting geometry, often in the form of a ring, fixes and supports the grinding body on the carrier. That supporting ring must be set back to correspond to the wear of the grinding ring in a machining process (like, for example, by turning down in a turning lathe).

A disadvantage with that manufacturing process is that two hot-pressing operations have to be used. In addition, the grinding ring can be damaged upon being removed from the first mold. After removal from the first mold, sintering edges and contamination on the grinding ring have to be removed.

A further disadvantage which has nothing to do with the manufacturing process but with use of the wheel is that, upon the supporting edge being set back by a turning apparatus like a turning lathe, this involves time and work. In a further manufacturing variant, an independent supporting ring of plastic material is fitted behind the grinding body. In that case, the grinding body and the cup are produced separately from each other and then glued together. That is the case for example when, by virtue of its shape, the grinding body cannot be pushed over a ring which is shaped by the carrier. Subsequently, after the grinding body is glued to the grinding cup, the supporting ring is produced by molding a plastic material like, for example, epoxy resin, and an additional mold is required for that purpose.

That manufacturing variant also entails serious disadvantages: the grinding body and the grinding cup are produced separately from each other each in their own dedicated mold. Additional working steps like internal molding using an epoxy resin to provide the supporting ring and gluing the grinding body to the carrier in themselves constitute increased effort and complication. In addition, before the grinding body is glued to the carrier, a primer has to be applied to the adhesive surfaces in order to pre-treat them. Otherwise, it is not possible to ensure an adequate adhesive bond. Before the surfaces of the grinding body and the cup which are to be joined are glued together, they have to be pre-treated, for example, by sand blasting and degreasing with an agent like, for example, acetone and coated with a primer.

SUMMARY OF THE INVENTION

The object of the invention is to avoid the above-described disadvantages and to provide a cup grinding wheel which is improved over the state of the art and a process for the production of such a cup grinding wheel.

In the case of the cup grinding wheel according to the invention, that is achieved in that the grinding body is connected only by the binding region having the annular surface to the annular mounting surface of the carrier.

In a further embodiment, it can be provided that the grinding body is substantially completely shaped in the form of a cone ring. A configuration in the form of cone ring means that less material is required for the structure of the grinding body, and less mass has to be set in movement when bringing the grinding wheel into operation.

If the grinding body provides a binding region in the form of an annular surface, then it can be fixed to a carrier by way of that binding region in the form of the annular surface.

In that respect, it has proven to be particularly advantageous if the cup-shaped carrier at its end edge region has an annular mounting surface, and at that mounting surface it can receive the binding region of the grinding body.

In a further embodiment, it can be provided that after the grinding body is connected to the carrier in the transitional region, no separation layer is visible between the grinding body and the carrier, wherein in the hot-pressing operation, fusing is effected between the materials of the grinding body and the carrier. That therefore involves a strong connection between the grinding body and the carrier, and it is possible to dispense with a supporting ring. The connection is substantially stronger than a connection made by adhesive or the like.

If the inside grinding surface at the inside of the grinding body is not covered by the cup-shaped carrier and thus the inside can also be used as an inside grinding surface, then that cup grinding wheel permits a wider spectrum of machining options. In addition, in the case of wear of the grinding body, the supporting ring does not have to be cut away by, for example, a turning lathe.

In a further embodiment, it can be provided that no supporting ring is necessary for fixing the grinding body to the carrier and thus the inside can also be used as an inside grinding surface. That therefore enlarges the spectrum of machining options which are made possible by the cup grinding wheel.

If no additional temperature is supplied in the step of pre-shaping the grinding body and only the operation of pressing to the cup-shaped carrier is effected under the action of heat, further working steps are avoided and energy costs are reduced.

In a further embodiment, it can be provided that, for shaping the grinding body in the pre-shaping step, a grinding body top punch and a grinding body bottom punch are introduced into the pressing ring and pressure is applied to the material disposed between the punches for the grinding body. That therefore provides that the material for the grinding body is hardened and it remains pre-shaped in its position to be joined to the carrier in the next steps. Removal of the grinding body is not necessary.

If in a hot-shaping step the grinding body bottom punch is removed and replaced by a carrier bottom punch having a pin and in that case the material for the cup-shaped carrier is introduced, wherein the pre-shaped grinding body remains in its position in the pressing ring, there is a saving in working time and the risk of the grinding ring being damaged upon shaping thereof is minimized.

In a further embodiment, it can be provided that, in the hot-shaping step, a carrier top punch is introduced into the grinding body top punch and the carrier top punch together with the grinding body top punch is pressed against the carrier bottom punch, wherein the grinding body is hot-pressed to the cup-shaped carrier. The joint hot pressing of carrier and grinding body gives rise to mingling of the materials in the carrier and in the grinding body. In that case, a connection is made, which does not have any separation line. By virtue of that very good join, there is no need to incorporate a supporting ring. It is also not necessary for the carrier itself to shape a supporting ring which supports the grinding body.

In that respect, it has proven to be particularly advantageous if the cup-shaped carrier is made from a metallic material when the grinding body has metallic binding agents and the cup-shaped carrier is made from a plastic material, preferably synthetic resin, when the grinding body has a synthetic resin as binding agent. If synthetic resin is used as the binding agent in the carrier, a filler material like preferably metal powder is added. That ensures that a join of the materials between the carrier and the grinding body can occur without a separation line.

A process for the production of a cup grinding wheel including a cup-shaped carrier and an annular grinding body is also provided.

BRIEF DESCRIPTION OF THE DRAWINGS

Further details and advantages of the present invention will be described in greater detail hereinafter by means of the specific description with reference to the embodiments by way of example illustrated in the drawings in which.

DETAILED DESCRIPTION OF THE INVENTION

Figure 1A:
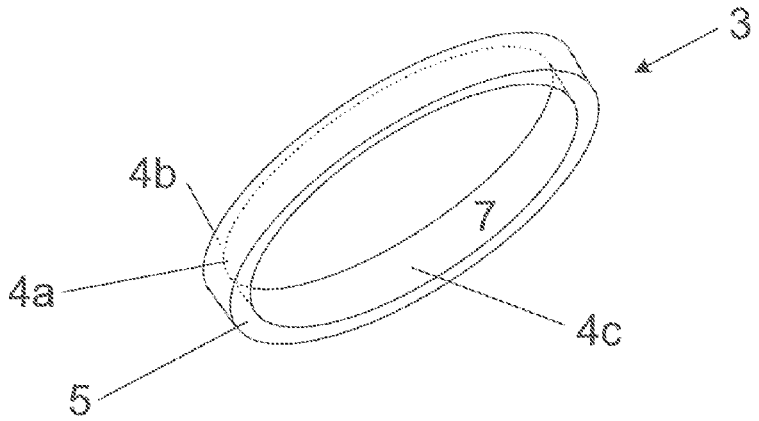
FIG. 1*a* shows a diagrammatic view of an annular grinding body.

FIG. 1*a* shows a grinding body 3. The grinding body 3 which is made from super abrasive grain and a binding agent preferably has four surfaces. Disposed at the end faces of the annular grinding body 3 are, respectively, a binding region 5 and a face grinding surface 4*b*. At the outside the grinding body 3 forms an outside grinding surface 4*a*. The inside 7 of the grinding body 3 forms the inside grinding surface 4*c*.

Figure 1B:
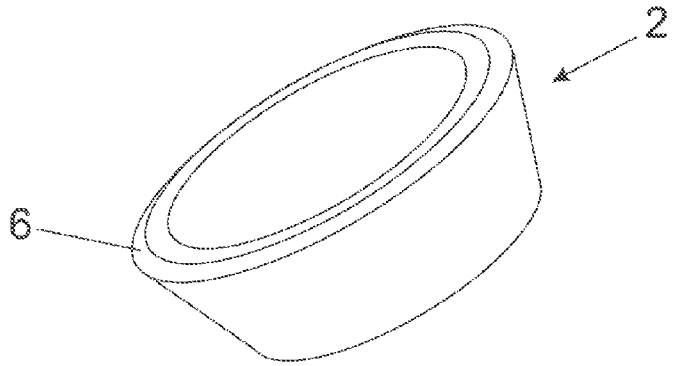
FIG. 1*b* shows a diagrammatic view of a cup-shaped carrier.

FIG. 1*b* shows a cup-shaped carrier 2. Depending on the material from which the grinding body 3 (not shown in FIG. 1*b*) is made, the carrier 2 is produced substantially completely from metal or plastic material. The common variant represents a combination of plastic and metal, as can also be seen in the detail view X in FIG. 2*b*. The cup-shaped carrier 2 at one of its end faces forms the mounting surface 6. In addition, the carrier 2 has an opening disposed in the bottom of the carrier 2. That is not visible in the view in FIG. 1*b* as it is concealed by the peripheral portion of the carrier 2. The cup grinding wheel 1 is clamped to a grinding apparatus by way of that mounting opening 17 (not visible in FIG. 2*a* but shown in FIGS. 5*a* and 5*b*).

Figure 2A:
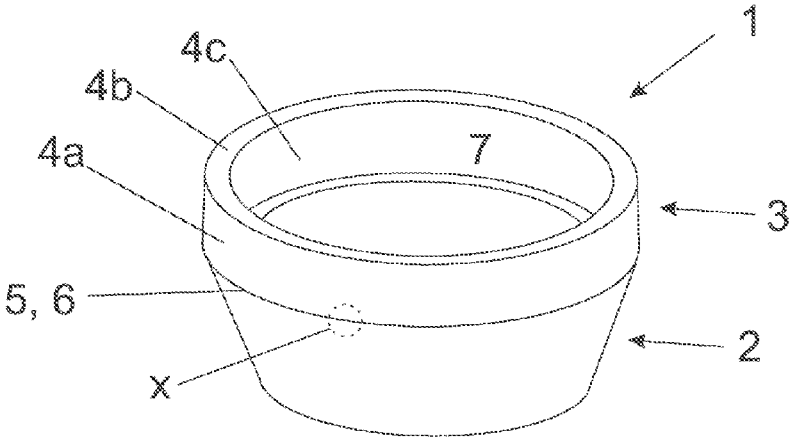
FIG. 2*a* shows a diagrammatic view of the grinding body fixed to the carrier.

FIG. 2*a* shows a grinding body 3 fixed to the carrier 2. For that purpose, the grinding body 3 is fused with its binding region 5 to the annular mounting surface 6 of the carrier 2. Even after fusion of the grinding body 3 to the carrier 2, the grinding surfaces 4*a*, 4*b* and 4*c* are still retained. Only the binding region 5 is lost by virtue of being fixed to the carrier 2 and thus cannot be used as a grinding surface. The detail X in FIG. 2*a* is described more fully in FIG. 2*b*.

Figure 2B:
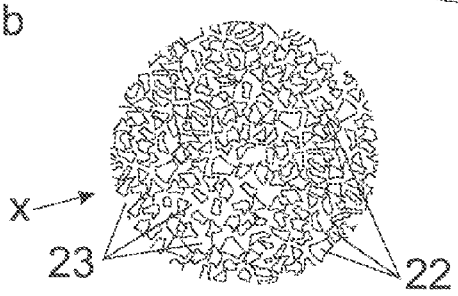
FIG. 2*b* shows a diagrammatic view of detail X.

FIG. 2*b* diagrammatically shows a detail view X from FIG. 2*a*. The detail view X shows that the material of the grinding body 3 has mingled with the material of the carrier 2. There is thus no separation plane between the grinding body 3 and the carrier 2. The forces received at the grinding body 3 are diverted into the carrier 2 by virtue of that homogeneous transition. The super abrasive agents 22 shown in FIG. 2*b* are held together by a binding agent 23. The binding agent 23 can both be of metallic origin or can comprise synthetic resin. A mixture of both would also be conceivable. In other words: a grinding body 3 with synthetic resin binding as the binding agent 23 is used on a carrier 2 with a synthetic resin mixture or metal-synthetic resin mixture. A metal powder is used for the carrier 2, for a grinding body 3 with a metal binding as the binding agent 23.

Figure 3:
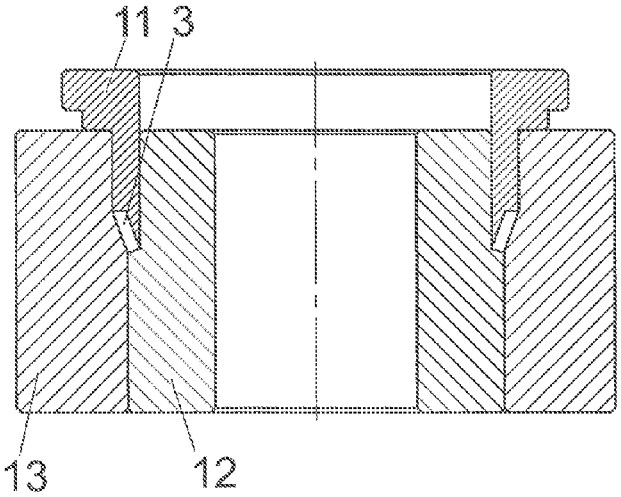
FIG. 3 shows a diagrammatic view of the molds used in the pre-shaping process.

FIG. 3 diagrammatically shows a manufacturing process, referred to as the pre-shaping step, in which the grinding body is pre-shaped in a mold comprising a pressing ring 13, a facing bottom punch 12 and a facing top punch 11. For that purpose, the mixture of binding agent 23 and super abrasive agent 22 is introduced into the region between the top punch 11, the bottom punch 12 and pressing ring 13. The material disposed there is hardened under pressure. In that case, no additional temperature is added. That cold pre-shaping operation affords the grinding body 3 which remains in its shape even when the bottom punch 12 is removed.

Figure 4:
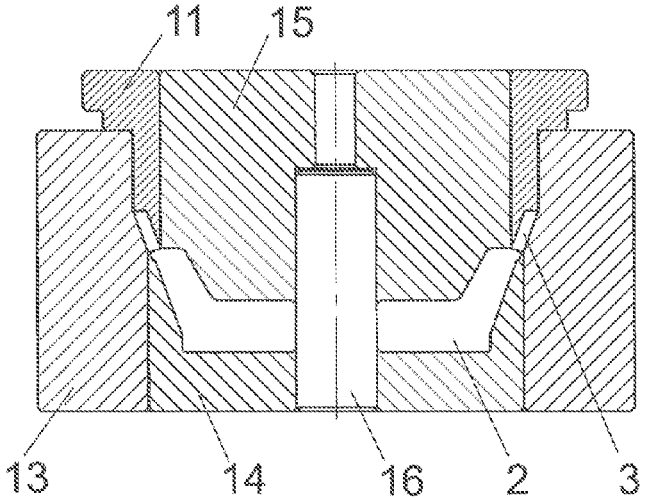
FIG. 4 shows a diagrammatic view of the molds used in the hot-pressing process.

FIG. 4 shows how the facing bottom punch 12 has been replaced by the carrier bottom punch 14. The grinding body 3 which has already been pre-shaped remains in its position even when the punches 14, 15 and 16 are changed. The carrier top punch 15 is introduced into the opening region of the top punch 11 after the material for the carrier 2 has been introduced. The opening 17 which is not visible in FIG. 4 and which is then provided for receiving the cup grinding wheel 1 on a grinding apparatus is shaped by the pin 16. The carrier 2 is shaped and at the same time fused to the grinding body 3 by pressure and heat in the hot-shaping step by virtue of the cooperation of the top punch 11, the carrier top punch 15, the carrier bottom punch 14, the pin 16 and the pressing ring 13. That saves working time, and the grinding body does not have to be removed from the mold between the steps—consequently, there is no risk of a breakage when shaping the grinding ring. The joint pressing operation in the hot-shaping step affords an optimum binding effect between the grinding body 3 and the carrier 2 so that a supporting ring 20 (not shown in FIG. 4) can be omitted. Fusion of the material between the grinding body 3 and the carrier 2 is visible under a microscope and can therefore also be demonstrated. In the production process by means of an adhesive join and in a standard production operation with two separation hot-shaping steps, a clear interface is to be noted under a microscope between the grinding body 3 and the carrier 2.

Figure 5A:
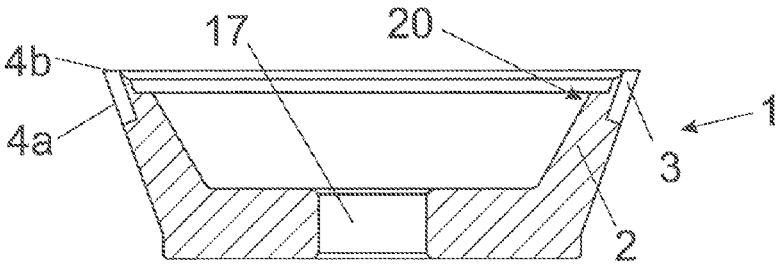
FIG. 5*a* shows a diagrammatic sectional view of a cup grinding wheel with supporting ring.

FIG. 5*a* shows a cup grinding wheel 1 with a supporting ring 20. In this embodiment, the supporting ring 20 is afforded by the carrier 2. The carrier 2 supports the grinding body 3. When the grinding body wears at its face, grinding surface 4*b* then the supporting ring 20 would have to be moved rearwardly by a turning-off operation using a turning lathe or another piece of equipment. For that purpose, the cup grinding wheel 1 is gripped at its mounting opening 17, for example in a turning lathe, and turned down rearwardly with a turning lathe tool. The operation of unclamping it from the grinding apparatus, clamping it in a suitable clamping means in a turning lathe by way of the mounting opening 17, turning off the supporting ring, unclamping it from the turning lathe and fitting it into the grinding apparatus requires many unnecessary working steps.

Instead of the supporting rings 20 which are shaped by the carrier, the rings could also be subsequently cast in place behind the grinding body 3 in bonded relationship with the carrier 2. That also requires many additional working steps in production of the cup grinding wheel.

Figure 5B:
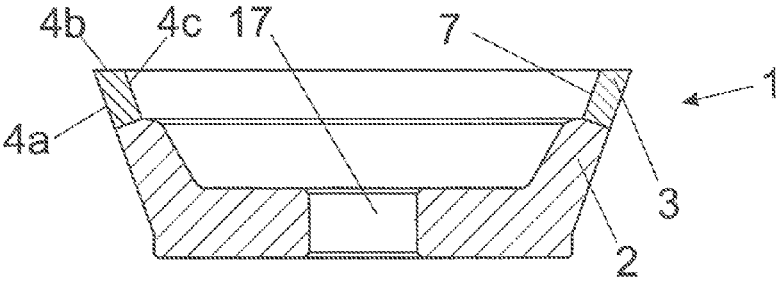
FIG. 5*b* shows a diagrammatic sectional view of a cup grinding wheel without supporting ring.

FIG. 5*b* shows the cup grinding wheel 1 according to the invention. It will be seen that no disruptive supporting ring 20 is fitted to the grinding body 3 or the carrier 2. Thus, there are three grinding surfaces—the outside grinding surface 4*a*, the face grinding surface 4*b* and the inside grinding surface 4*c*. Those three grinding surfaces can be used for machining a workpiece. If the cup grinding wheel 1 has to be cut back at its end grinding face 4*b* there is no supporting ring 20 that has to be subsequently subjected to machining.

The invention claimed is:

1. A cup grinding wheel including:

a cup-shaped carrier, and a single-piece annular grinding body, wherein the single-piece annular grinding body is connected only by a binding region having an annular surface to an annular mounting surface of the cup-shaped carrier such that the single-piece annular grinding body is completely outside the cup-shaped carrier, and wherein an inside grinding surface at an inside of the single-piece annular grinding body is not covered by the cup-shaped carrier and thus the inside of the single-piece annular grinding body can also be used as an inside grinding surface.

2. The cup grinding wheel as set forth in claim 1, wherein an end edge region of the cup-shaped carrier has the annular mounting surface.

3. The cup grinding wheel as set forth in claim 1, wherein the single-piece annular grinding body is connected to the cup-shaped carrier by a single hot-pressing operation, wherein, after the single-piece annular grinding body is connected to the cup-shaped carrier, no separation layer is visible between the single-piece annular grinding body and the cup-shaped carrier, and wherein, in the single hot-pressing operation, fusing or interpenetration is effected between materials of the single-piece annular grinding body and the cup-shaped carrier.

4. The cup grinding wheel as set forth in claim 2, wherein the single-piece annular grinding body is connected to the cup-shaped carrier by a single hot-pressing operation, wherein, after the single-piece annular grinding body is connected to the cup-shaped carrier, no separation layer is visible between the single-piece annular grinding body and the cup-shaped carrier, and wherein, in the single hot-pressing operation, fusing or interpenetration is effected between materials of the single-piece annular grinding body and the cup-shaped carrier.

5. A cup grinding wheel including:

a cup-shaped carrier, and a single-piece annular grinding body, wherein the single-piece annular grinding body is connected only by a binding region having an annular surface to an annular mounting surface of the cup-shaped carrier such that the single-piece annular grinding body is completely outside the cup-shaped carrier, and wherein no supporting ring is necessary for fixing the single-piece annular grinding body to the cup-shaped carrier and thus an inside of the single-piece annular grinding body can also be used as an inside grinding surface.

6. The cup grinding wheel as set forth in claim 5, wherein the single-piece annular grinding body is completely in the shape of a cone ring.

7. The cup grinding wheel as set forth in claim 5, wherein an end edge region of the cup-shaped carrier has the annular mounting surface.

8. The cup grinding wheel as set forth in claim 5, wherein the single-piece annular grinding body is connected to the cup-shaped carrier by a single hot-pressing operation, wherein, after the single-piece annular grinding body is connected to the cup-shaped carrier, no separation layer is visible between the single-piece annular grinding body and the cup-shaped carrier, and wherein, in the single hot-pressing operation, fusing or interpenetration is effected between materials of the single-piece annular grinding body and the cup-shaped carrier.

9. The cup grinding wheel as set forth in claim 6, wherein an end edge region of the cup-shaped carrier has the annular mounting surface.

10. The cup grinding wheel as set forth in claim 7, wherein the single-piece annular grinding body is connected to the cup-shaped carrier by a single hot-pressing operation, wherein, after the single-piece annular grinding body is connected to the cup-shaped carrier, no separation layer is visible between the single-piece annular grinding body and the cup-shaped carrier, and wherein, in the single hot-pressing operation, fusing or interpenetration is effected between materials of the single-piece annular grinding body and the cup-shaped carrier.

11. The cup grinding wheel as set forth in claim 7, wherein the single-piece annular grinding body is connected to the cup-shaped carrier by a single hot-pressing operation, wherein, after the single-piece annular grinding body is connected to the cup-shaped carrier, no separation layer is visible between the single-piece annular grinding body and the cup-shaped carrier, and wherein, in the single hot-pressing operation, fusing or interpenetration is effected between materials of the single-piece annular grinding body and the cup-shaped carrier.

12. A cup grinding wheel including:

a cup-shaped carrier, and a single-piece annular grinding body, wherein the single-piece annular grinding body is connected only by a binding region having an annular surface to an annular mounting surface of the cup-shaped carrier such that the single-piece annular grinding body is completely outside the cup-shaped carrier, wherein the single-piece annular grinding body is completely in the shape of a cone ring, and wherein an inside grinding surface at an inside of the single-piece annular grinding body is not covered by the cup-shaped carrier and thus the inside of the single-piece annular grinding body can also be used as an inside grinding surface.

13. The cup grinding wheel as set forth in claim 12, wherein an end edge region of the cup-shaped carrier has the annular mounting surface.

14. The cup grinding wheel as set forth in claim 12, wherein the single-piece annular grinding body is connected to the cup-shaped carrier by a single hot-pressing operation, wherein, after the single-piece annular grinding body is connected to the cup-shaped carrier, no separation layer is visible between the single-piece annular grinding body and the cup-shaped carrier, and wherein, in the single hot-pressing operation, fusing or interpenetration is effected between materials of the single-piece annular grinding body and the cup-shaped carrier.

15. The cup grinding wheel as set forth in claim 13, wherein the single-piece annular grinding body is connected to the cup-shaped carrier by a single hot-pressing operation, wherein, after the single-piece annular grinding body is connected to the cup-shaped carrier, no separation layer is visible between the single-piece annular grinding body and the cup-shaped carrier, and wherein, in the single hot-pressing operation, fusing or interpenetration is effected between materials of the single-piece annular grinding body and the cup-shaped carrier.

16. The cup grinding wheel as set forth in claim 1, wherein the single-piece annular grinding body is connected to the cup-shaped carrier by a single hot-pressing operation.

17. The cup grinding wheel as set forth in claim 5, wherein the single-piece annular grinding body is connected to the cup-shaped carrier by a single hot-pressing operation.

18. The cup grinding wheel as set forth in claim 12, wherein the single-piece annular grinding body is connected to the cup-shaped carrier by a single hot-pressing operation.

19. The cup grinding wheel as set forth in claim 1, wherein the single-piece annular grinding body is connected to the cup-shaped carrier in only one plane.

20. The cup grinding wheel as set forth in claim 5, wherein the single-piece annular grinding body is connected to the cup-shaped carrier in only one plane.

21. The cup grinding wheel as set forth in claim 12, wherein the single-piece annular grinding body is connected to the cup-shaped carrier in only one plane.

* * * * *